United States Patent [19]

Hofmann

[11] 4,092,001

[45] May 30, 1978

[54] FUEL INJECTION NOZZLE FOR INTERNAL COMBUSTION ENGINES

[75] Inventor: Karl Hofmann, Neckarrems, Germany

[73] Assignee: Robert Bosch GmbH, Stuttgart, Germany

[21] Appl. No.: 745,718

[22] Filed: Nov. 29, 1976

[30] Foreign Application Priority Data

Dec. 6, 1975 Germany ..... 2554987

[51] Int. Cl.[2] ..... B05B 1/30

[52] U.S. Cl. ..... 239/533.6; 239/580; 267/175

[58] Field of Search ..... 239/533.6, 533.9, 580; 267/175, 177, 172; 123/188 SA, 188 SB

[56] References Cited

U.S. PATENT DOCUMENTS

| | | | |
|---|---|---|---|
| 2,506,218 | 5/1950 | Ingram | 267/177 X |
| 2,735,669 | 2/1956 | Seiler | 267/175 |
| 3,567,133 | 3/1971 | Gewinner | 239/533.6 |

*Primary Examiner*—Joseph F. Peters, Jr.
*Assistant Examiner*—Michael Mar
*Attorney, Agent, or Firm*—Edwin E. Greigg

[57] ABSTRACT

A fuel injection nozzle for internal combustion engines which includes a blind bore disposed transversely to the axis of the nozzle, in which bore is provided an adjustment mechanism for exteriorly varying the pre-loaded tension of a closing spring acting on the needle valve of the fuel injection nozzle. Plural embodiments disclose that variance in the spring loading is achieved by rotating the adjustment mechanism through different positions to urge the spring downwardly against a cap retaining the spring. The adjustment mechanism is sealed against fuel leakage from the bore and retained therein by the force of the spring plate on a surface cooperative therewith.

7 Claims, 4 Drawing Figures

FUEL INJECTION NOZZLE FOR INTERNAL COMBUSTION ENGINES

BACKGROUND OF THE INVENTION

The invention relates to a fuel injection nozzle for internal combustion engines with a closing spring preloading the position of a needle valve, the tension on which is varied by an adjustment mechanism arranged to shift a spring support, which mechanism is accessible exteriorly of the injection nozzle and is operable through rotation thereof.

In a known fuel injection nozzle, an adjusting screw with a counter nut, disposed in the axis of the nozzle in a nozzle holder, serves as rotatable means with said adjusting screw arranged to move a cap supported on a spring. Since one side of the fuel injection nozzle is required for connection with a fuel line, it was not possible hitherto in known fuel injection nozzles to either align or change the closing force of the spring without completely disassembling the nozzle. Such a change in the tension of the locking spring becomes necessary as a result of a gradual fatigue of the spring or as a result of adaptation of a particular fuel injection nozzle to different engines requiring varying opening pressures of the injection nozzle. It also should be noted that the diameters of the fuel injection nozzles are relatively small, as a result of the requirements of the producers of the internal combustion engines and that such an apparatus for the change of the pre-load tension of the locking spring is exposed to extraordinarily strong forces, requiring a correspondingly sturdy construction.

OBJECT AND SUMMARY OF THE INVENTION

The invention has as its object the development of a fuel injection nozzle of the initially described type, wherein the change or adjustment of the force of the closing spring is possible without disassembly of the fuel injection nozzle, and yet, where one end is still available for connection to the fuel supply.

According to the present invention, this object will be achieved by the apparatus being disposed in a blind bore which extends transversely of the axis of the fuel injection nozzle, the construction being such that the closing spring will prevent a slippage of the apparatus from its position and a threaded adjusting means for said spring is accessible from one longitudinal side of the fuel injection nozzle.

Since such adjustments are preferably accomplished by means of a screwdriver, the engagement of the tool with the threaded means is advantageous even where the fuel injection nozzles are disposed transversely to the longitudinal cross section of the engine, so that when the nozzle is correspondingly positioned, the apparatus will be easily accessible from either side from which the engine is viewed.

The invention will be better understood as well as other objects and advantages thereof become more apparent from the following detailed description of the invention taken in conjunction with the drawing.

DESCRIPTION OF THE PREFERRED EMBODIMENT

Figure 1:
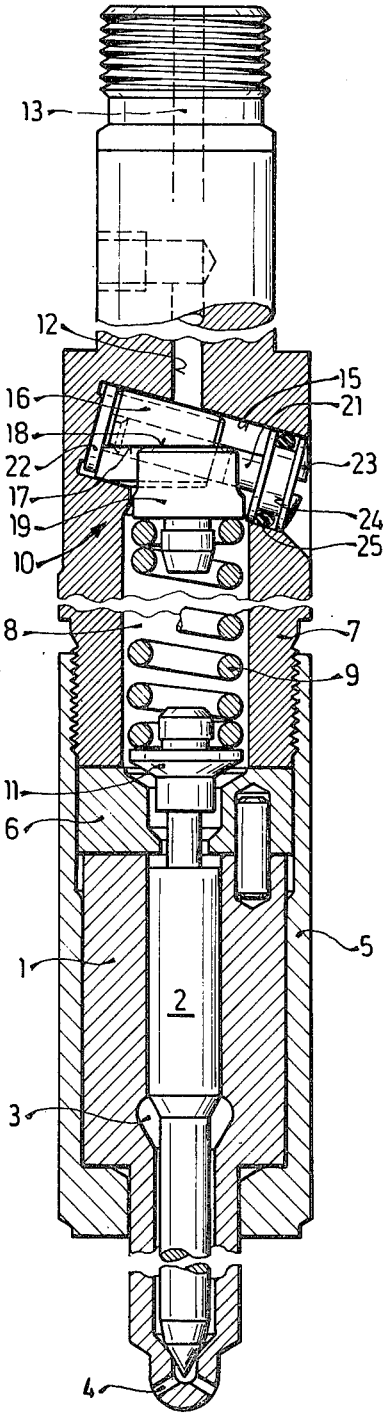
FIG. 1 is a cross-sectional view of a first embodiment of the invention with a wedge type adjusting means.

A nozzle needle 2 is disposed and sectionally sealed in a nozzle body 1 so as to be axially shiftable. A pressure chamber 3 is provided delimited by the nozzle body 1 and the needle valve 2, from which, after axial shifting of the needle valve, the fuel fed in by an injection pump (not shown) reaches the combustion chamber of the engine via the spray apertures 4.

The nozzle body 1 is clamped on a nozzle holder 7 by a screw cap 5 with a disc 6 provided therebetween, which nozzle holder is provided with a recess 8 for receiving a locking spring 9. The locking spring 9 is supported at one extremity thereof by a spring plate 19 adjacent an adjustment means 10 of the nozzle holder 7, the other extremity acting on the nozzle needle 2 through a spring plate 11. The recess 8 is relieved of pressure by a longidutinal bore 12 extending through the nozzle holder 7. The fuel supplied by the injection pump (not shown) is fed in by a pressure line 13, only a portion of which has been indicated, through the nozzle holder and the nozzle body to the pressure chamber 3.

The pre-loaded tension of the spring 9 can be changed by means of an adjustment means 10, so that the nozzle, especially in an assembled state, can be adjusted with regard to the opening pressure, or so that changes in the opening pressure resulting from wear or fatigue of the spring can be corrected.

Figure 2:
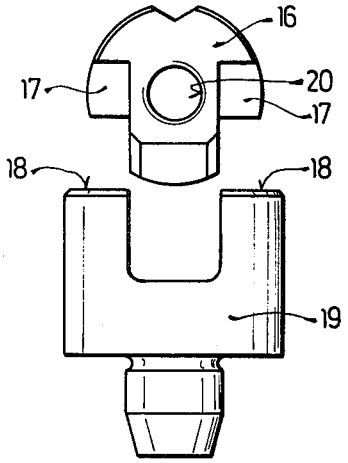
FIG. 2 is an exploded view of the adjusting means turned at 90°.

In the first embodiment, shown in FIGS. 1 and 2, of such an adjustment means 10 for the changing of the closing force of the spring 9, a pin 16 has been mounted shiftably in a bore 15 disposed obliquely in relation to the nozzle holder 7, the axis of which bore has been inclined in relation to the axis of the fuel injection nozzle. The pin is comprised of a part which is generally cylindrical on the side opposite the locking spring 9, but which is provided with wedge-shaped bevels 17 on the other side adjacent to the locking spring. The bevels 17 slide at least partially on surfaces 18, which are provided at one extremity of a spring cap 19, and which surfaces are disposed, like the bevels 17, at a right angle in relation to the axis of the closing spring 9, which in these embodiments coincides with the axis of the injection nozzle.

Turning now to FIG. 2, between the assigned bevels 17 and the surfaces 18, a U-shaped guide has been provided to prevent the pin 16 from twisting in the bore 15. In the pin 16, a threaded bore 20 has been disposed coaxially with the bore 15 and provided with a spindle screw 21. The spindle screw is supported at one end on a washer 22, which disposed at the farthest extent of the bore 15. The head 23 of the spindle screw 21 has an annular groove 24 in which an O-ring 25 has been disposed to seal the head 23 in the bore 15. It will be noted that this head 23 includes a kerf for the engagement of a suitable tool such as a screwdriver. Therefore, during operation the fuel collecting in the recess 8, which communicates with the channel 12, and thus with the bore 15, remains sealed against leakage by the O-ring 25.

Upon a twisting of the spindle screw 21, the pin 16 is shifted in the bore 15 transversely to the axis of the fuel injection nozzle. As a result, the spring cap 19 is shifted in the axial direction of the nozzle so as to change the pre-loaded tension in the locking spring 9.

Figure 3:
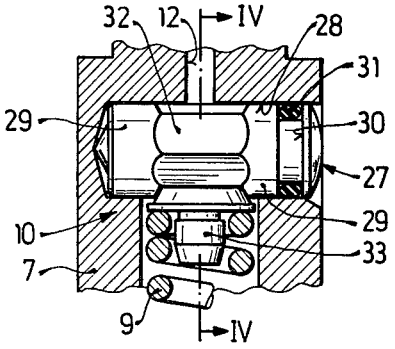
FIG. 3 is a partial cross-sectional view of a second embodiment of the invention with a polygonal adjusting mechanism.
Figure 4:
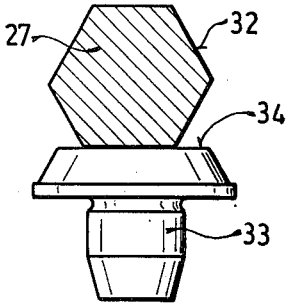
FIG. 4 is a cross-sectional view on an enlarged scale on line IV–IV of FIG. 3.

In the second embodiment, shown in FIGS. 3 and 4, the fuel injection nozzle is in principle similar to the one shown in FIG. 1. In this embodiment, a bolt 27, which is disposed in a bore 28, controls the adjustment means 10 allowing change to be made in the pre-loaded tension in the locking spring 9, said bore disposed perpendicularly to the axis of the fuel injection nozzle. The bolt is provided at one extremity with a terminus 29 and at its opposite extremity with an annular groove 30, in which an O-ring 31 is disposed as a seal against leakage. Medial of the bolt 27, bevels 32 have been provided, so that, as can be seen in FIG. 4, the cross section of the bolt 27 in this area has a polygonal contour. The bevels 32 of the bolt 27 cooperate with the spring plate 33 for retention of the locking spring 9, so that, depending upon the position of rotation of the bolt 27, one of the surfaces 32 meshes with the top surface 34 of the spring plate 33. Since the bevels 32 have been selected of varying depths to the bolt center, the spring plate 33 is shifted a greater or lesser distance depending upon the position of rotation of the bolt 27. The larger the radius from bolt center to bolt surface 32, the greater the shifting of the spring plate 33, thus the stronger the pre-loading of the spring 9.

In both embodiments, the adjustment apparatus, i.e., in the first embodiment pin 16 with the spindle screw 21, and in the second embodiment the bolt 27, is secured against the locking spring 9 with interposition of the spring plate 19 so that the bolt is retained against axial slippage. In the first embodiment, the wedge 16, with adjustment of the wedge bevels and the U-shaped guide in the spring cap, is pushed into the bore up to the axis of the injection nozzle, whereas in the second embodiment, the spring plate 33 is urged into alignment medially of the bolt 27 between the terminus 29 and the O-ring seal 30 onto one of the surfaces 32 by the spring 9, so that the bolt 27 cannot slide out of the bore. The length of the bevels 32 is arranged to correspond with the diameter of the top surface 34 of the spring cap 33, so that uniform pressure is exerted on the spring plate and the spring.

It is to be appreciated that the foregoing description and accompanying figures are illustrative embodiments of an improved fuel injection nozzle given by way of example not by way of limitation. Numerous variants and other embodiments are possible within the spirit and scope of the invention, the scope being defined by the appended claims.

What is claimed is:

1. In a fuel injection nozzle for an internal combustion engine, including: a needle valve; means defining a valve seat; a spring plate; a spring engageable at one end with the needle valve and at the other end with the spring plate, said spring providing a biasing force serving to bias the needle valve into engagement with the valve seat; and housing means defining a longitudinally extending bore within which the needle valve, valve seat defining means, spring plate and spring are located, the improvement comprising:

a bore extending generally transversely into said housing and defining an open end; and adjustment means mounted in the generally transversely extending bore and retained therein through the engagement of said adjustment means with said spring plate and by the biasing force of said spring, said adjustment means being accessible through said open end for adjusting the bias force of said spring.

2. The fuel injection nozzle as defined in claim 1, wherein the adjustment means comprises: a slide member; and a spindle screw engageable with the slide member for shifting the slide member within the generally transversely extending bore.

3. The fuel injection nozzle as defined in claim 2, wherein the generally transversely extending bore is a blind bore, and wherein the slide member comprises a round pin having at least one flattened surface which extends perpendicularly to the active axis of said spring when the slide member is located within the generally transversely extending bore.

4. The fuel injection nozzle as defined in claim 3, wherein the spring plate includes a surface which engages the flattened surface of said pin preventing thereby rotation of said pin.

5. The fuel injection nozzle as defined in claim 2, wherein the adjustment means further comprises: a seal, and wherein the spindle screw includes a head which defines an annular groove within which the seal is located, said seal engaging the surface defining the generally transversely extending bore.

6. The fuel injection nozzle as defined in claim 1, wherein the generally transversely extending bore is a blind bore and extends perpendicular to the active axis of said spring, wherein the adjustment means comprises: a bolt having terminal guide portions and cam means between said terminal guide portions, said cam means including a plurality of surfaces which are situated at varying distances from the center of said bolt, each of which engages said spring plate and controls a different biasing force in said spring.

7. The fuel injection nozzle as defined in claim 6, wherein the adjustment means further comprises: a seal, and wherein the bolt defines an annular groove in one of its terminal guide portions within which the seal is located, said seal engaging the surface defining the generally transversely extending bore.

* * * * *